US008083932B2

(12) United States Patent
Baumgartner et al.

(10) Patent No.: US 8,083,932 B2
(45) Date of Patent: Dec. 27, 2011

(54) PROCESS FOR PRODUCING LOWER OLEFINS FROM HYDROCARBON FEEDSTOCK UTILIZING PARTIAL VAPORIZATION AND SEPARATELY CONTROLLED SETS OF PYROLYSIS COILS

(75) Inventors: Arthur James Baumgartner, Houston, TX (US); Robert Lawrence Blackbourn, Houston, TX (US); Danny Yuk Kwan Ngan, Houston, TX (US)

(73) Assignee: Shell Oil Company, Houston, TX (US)

( * ) Notice: Subject to any disclaimer, the term of this patent is extended or adjusted under 35 U.S.C. 154(b) by 338 days.

(21) Appl. No.: 12/195,970

(22) Filed: Aug. 21, 2008

(65) Prior Publication Data

US 2009/0054716 A1 Feb. 26, 2009

Related U.S. Application Data

(60) Provisional application No. 60/957,533, filed on Aug. 23, 2007.

(51) Int. Cl.
*C10G 51/06* (2006.01)

(52) U.S. Cl. ..... 208/80; 208/78; 208/106; 208/125; 208/128; 208/130; 208/132; 585/648; 585/650; 585/652

(58) Field of Classification Search ..... 585/648, 585/650, 652, 302; 208/130, 78, 80, 106, 208/125, 128, 132
See application file for complete search history.

(56) References Cited

U.S. PATENT DOCUMENTS 3,617,493 A * 11/1971 Wirth et al. ..... 208/80
4,264,432 A 4/1981 Gartside ..... 208/48 R
4,498,629 A 2/1985 Grondman ..... 239/434.5
(Continued)

FOREIGN PATENT DOCUMENTS

GB 2128201 4/1984
(Continued)

OTHER PUBLICATIONS

Barker, "Petroleum" in Kirk-Othmer Encyclopedia of Chemical Technology, J. Wiley and Sons, published on-line May 13, 2005.*

(Continued)

*Primary Examiner* — In Suk Bullock
*Assistant Examiner* — Bradley Etherton

(57) ABSTRACT

A process for making lower olefins from a wide boiling range hydrocarbon feed by use of a combination of one or more vapor/liquid separation devices, and then pyrolytically cracking the vapor phase in separate sets of pyrolysis radiant tubes, thereby producing a higher level of lower olefin product.

28 Claims, 3 Drawing Sheets

U.S. PATENT DOCUMENTS

| | | | | | |
|---|---|---|---|---|---|
| 4,552,644 | A | * | 11/1985 | Johnson et al. | 208/78 |
| 4,615,795 | A | | 10/1986 | Woebcke et al. | 208/72 |
| 4,908,121 | A | | 3/1990 | Hackemesser et al. | 208/85 |
| 5,178,217 | A | * | 1/1993 | Mohammadi et al. | 166/268 |
| 5,580,443 | A | | 12/1996 | Yoshida et al. | 208/130 |
| 5,817,226 | A | * | 10/1998 | Lenglet | 208/130 |
| 5,840,582 | A | * | 11/1998 | Ngan | 436/55 |
| 5,976,352 | A | * | 11/1999 | Busson et al. | 208/75 |
| 5,981,818 | A | * | 11/1999 | Purvis et al. | 585/519 |
| 6,632,351 | B1 | * | 10/2003 | Ngan et al. | 208/132 |
| 6,979,757 | B2 | | 12/2005 | Powers | 585/648 |
| 7,090,765 | B2 | | 8/2006 | Spicer et al. | 208/130 |
| 7,097,758 | B2 | | 8/2006 | Stell et al. | 208/48 R |
| 7,128,827 | B2 | | 10/2006 | Tallman et al. | 208/78 |
| 7,138,047 | B2 | | 11/2006 | Stell et al. | 208/130 |
| 7,193,123 | B2 | | 3/2007 | Stell et al. | 585/652 |
| 7,220,887 | B2 | | 5/2007 | Stell et al. | 585/647 |
| 7,396,449 | B2 | * | 7/2008 | Powers | 208/130 |
| 2004/0122276 | A1 | | 6/2004 | Ngan | 585/648 |
| 2005/0261531 | A1 | | 11/2005 | Stell et al. | 585/648 |
| 2006/0226048 | A1 | | 10/2006 | Stell et al. | 208/125 |
| 2007/0004952 | A1 | | 1/2007 | McCoy et al. | 585/648 |
| 2007/0006733 | A1 | | 1/2007 | Stell et al. | 95/266 |
| 2007/0009407 | A1 | | 1/2007 | Stell et al. | 422/188 |
| 2007/0031306 | A1 | | 2/2007 | Stell | 422/189 |
| 2007/0049783 | A1 | | 3/2007 | Stell et al. | 585/648 |
| 2007/0055087 | A1 | | 3/2007 | Powers | 585/648 |
| 2007/0090018 | A1 | | 4/2007 | Keusenkothen et al. | 208/106 |
| 2007/0090020 | A1 | | 4/2007 | Buchanan et al. | 208/106 |

FOREIGN PATENT DOCUMENTS

| | | | |
|---|---|---|---|
| WO | WO0155280 | | 8/2001 |
| WO | WO 0155280 | A1 * | 8/2001 |
| WO | WO2007030276 | | 3/2007 |

OTHER PUBLICATIONS

Hiller, et al., "Gas Production" in Ullmann's Encyclopedia of Industrial Chemistry, J. Wiley and Sons, published on-line Dec. 15, 2006.*

Speight, "Refinery Processes" in Kirk-Othmer Encyclopedia of Chemical Technology, 4th edition, J. Wiley and Sons, 1996.*

"Large ethylene furnaces: changing the paradigm" by John R. Brewer of the Stone and Webster Corporation, (published in the ePTQ magazine, 2nd Quarter issue of 2000, pp. 111-116).

* cited by examiner

PROCESS FOR PRODUCING LOWER OLEFINS FROM HYDROCARBON FEEDSTOCK UTILIZING PARTIAL VAPORIZATION AND SEPARATELY CONTROLLED SETS OF PYROLYSIS COILS

This application claims the benefit of U.S. Provisional Application No. 60/957,533 filed Aug. 23, 2007 which is incorporated herein by reference.

FIELD OF THE INVENTION

This invention relates to the processing of a hydrocarbon feedstock having a wide boiling range in order to produce lower olefins.

BACKGROUND OF THE INVENTION

Pyrolytic cracking of hydrocarbons is a petrochemical process that is widely used to produce olefins such as ethylene, propylene, butylenes, butadiene, and aromatics such as benzene, toluene, and xylene. The starting feedstock for a conventional olefin production plant is typically subjected to substantial (and expensive) processing before it reaches the olefin plant. For instance, normally, whole crude is first subjected to desalting prior to being distilled or otherwise fractionated into a plurality of parts (fractions) such as gasoline, kerosene, naphtha, atmospheric gas oils, vacuum gas oils (VGO) and pitch, (also called "short resid" or "short residue" or "Vacuum Tower Bottom"). As an alternate to the production of vacuum gas oils and pitch, sometimes a combination of these (usually given the name "long resid" or "long residue") is produced. The short resid cut typically has a boiling range that begins at a temperature greater than 1050° F. (566° C.), at atmospheric pressure. After removal of the short resid fraction from crude oil or long resid, conventionally, any of their fractions or combinations of them may be passed to a steam cracker as the feedstock. Alternatively, whole crude, after desalting and removal of the "short resid" can also be used as a feedstock.

Conventional steam cracking processes to produce olefins utilize a pyrolysis furnace that generally has two main sections: a convection section and a radiant section. In the conventional pyrolysis furnace, the hydrocarbon feedstock enters the convection section of the furnace as a liquid (except for light feedstocks such as ethane and propane which enter as a vapor) wherein it is heated and vaporized by indirect contact with hot flue gas from the radiant section of the furnace and optionally by direct contact with steam. The feedstock is normally mixed with steam and the feedstock/steam mixture is then introduced through crossover piping into the radiant section where it is quickly heated, at pressures typically ranging from about 10 to about 30 psig, to typical pyrolysis temperatures such as in the range of from about 1450° F. (788° C.) to about 1562° F. (850° C.), to provide thorough pyrolytic cracking of the feed stream. The resulting olefin rich pyrolysis products leave the furnace for further downstream separation and processing.

A recent advance in pyrolysis of crude oil and crude oil fractions containing pitch is shown in U.S. Pat. No. 6,632,351. In the '351 process a crude oil feedstock or crude oil fraction(s) containing pitch is fed, after desalting, directly into a pyrolysis furnace. The process comprises feeding the crude oil or crude oil fractions containing pitch to a first stage preheater within the convection section, where the crude oil or crude oil fractions containing pitch are heated within the first stage preheater to an exit temperature of at least 375° C.

to produce a heated gas-liquid mixture. The mixture is withdrawn from the first stage preheater, steam is added and the gas-liquid mixture is fed to a vapor/liquid separator, followed by separating and removing the gas from the liquid in the vapor/liquid separator, and feeding the removed gas to a second preheater provided in the convection zone. The preheated gas is then introduced into a radiant zone within the pyrolysis furnace, and pyrolyzed to olefins and associated by-products. While this is an improvement in the overall process, there are still limitations in achieving higher yields of more valuable products, particularly from the lighter fraction of the vaporized feed. These limitations are due to the conversion to olefins being limited by the milder pyrolysis conditions required to prevent rapid coke formation from pyrolysis of the heavy fraction, either in the pyrolysis coils and/or in the downstream quench exchangers.

U.S. Pat. No. 6,979,757 discloses a process utilizing whole crude oil as a feedstock for the pyrolysis furnace of an olefin production plant wherein the feedstock after preheating is subjected to mild thermal cracking assisted with controlled cavitation conditions until substantially vaporized, the vapors being subjected to severe cracking in the radiant section of the furnace. This process is similarly limited as in the '351 patent as the entire vapor stream is subjected to one pyrolysis severity.

U.S. Pat. No. 4,264,432 discloses a process and system for vaporizing heavy gas oil prior to thermal cracking to olefins, by flashing with steam in a first mixer, superheating the vapor, and flashing in a second mixer the liquid from the first mixer. Such a process is primarily directed to minimizing the amount of dilution steam required for vaporization of heavy gas oils having an end point of about 1005° F. (541° C.) prior to pyrolysis cracking of the heavy oil, and is not directed to creating an acceptable pyrolysis feedstock from an otherwise unacceptable feedstock having undesirable coke precursors and/or high boiling pitch fractions. Again this process is limited as in the '351 and '432 patents described above since the entire vaporized feedstock is cracked at one pyrolysis severity.

U.S. Pat. No. 3,617,493 discloses a process for steam cracking a crude oil feed by first passing it through the convection of a first steam cracking furnace, then separating out in a flash drum separator a vaporized fraction (naphtha and lighter components fraction), and a liquid fraction. The naphtha and lighter fraction is then pyrolyzed in the first cracking furnace. The liquid separated from the flash drum separator is withdrawn and fed to the convection section of a second steam cracking furnace, and thereafter into a second flash drum separator; the vapor from this second separator is then pyrolyzed in a second steam cracking furnace. The use of two separate steam cracking furnaces allows the lighter fraction and the heavier fraction of the crude oil feed to be cracked under different cracking conditions to optimize yields. However, the use of two separate cracking furnaces can be a very costly process choice. Moreover, the process claimed in the '493 patent cannot be easily changed to accommodate changing feed compositions.

U.S. Pat. No. 4,612,795 discloses a process and system for the production of olefins from heavy hydrocarbon feedstocks, by first pretreating the hydrocarbon at high pressure and moderate temperatures to preferentially remove coke precursors. The pretreated hydrocarbon is then separated into a lighter and a heavier fraction in a conventional fractionation column. The lighter and heavier fractions are fed to a pyrolysis furnace having two separate radiant cells. The lighter fraction is cracked in one radiant cell and the heavier fraction in cracked in the other radiant cell thus allowing the two fractions to be cracked separately at their optimal cracking conditions. The heavy bottom product from the fractionation column is used as fuel oil. While U.S. Pat. No. 3,617,493 and U.S. Pat. No. 4,612,795 teach the benefits of separately cracking fractions of wide boiling feedstocks at pyrolysis conditions appropriate for those fractions, they require additional equipment beyond one pyrolysis furnace and are only applied to feedstocks with undesirable heavy feedstock components such as pitch.

It is further known that state-of-the-art pyrolysis furnaces having two separate feedstocks are currently built by pyrolysis furnace designers such as the Stone and Webster division of Shaw Industries. Further details of pyrolysis furnaces with one and two radiant cells cracking two feedstocks simultaneously at optimum cracking conditions are revealed in the article: "Large ethylene furnaces: changing the paradigm" by John R. Brewer of the Stone and Webster Corporation, (published in the ePTQ magazine, $2^{nd}$ Quarter issue of 2000, pages 111-116). However, in such designs the two feedstocks that are simultaneously fed to the furnaces are already separated, i.e. they are not fed to the furnace as a single wide boiling range feedstock.

The prior art cited above does not teach how to efficiently separate and pyrolyze the various fractions in a wide boiling feedstock to obtain the highest potential yield of olefins using only one steam cracking furnace with one feedstock. What is needed is an improved process that permits the economical processing of a hydrocarbon feedstock having a wide boiling range to produce lower olefins in higher yield by separately cracking the various fractions at the optimal conditions for those fractions in one furnace.

SUMMARY OF THE INVENTION

The present invention relates to a process for pyrolyzing a wide boiling range vaporizable hydrocarbon feedstock or mixtures of hydrocarbon feedstocks having a wide boiling range, consisting of a variety of hydrocarbons of differing carbon/hydrogen ratios and/or molecular weights in a pyrolysis furnace having a convection section and at least two sets of independently controlled radiant section pyrolysis coils to produce olefins and other pyrolysis products, comprising:

a. heating and partially vaporizing the feedstock, and feeding the partially vaporized feedstock to a vapor/liquid separator device to produce separate vapor and liquid phases;
b. feeding the vapor phase to a first set of radiant pyrolysis coils of the pyrolysis furnace where the hydrocarbons are cracked to produce olefins; the cracking conditions in the first set of radiant pyrolysis coils being controlled to achieve a cracking severity appropriate for the quality of this first feed fraction,
c. heating and fully vaporizing the liquid phase from the vapor/liquid separator, feeding the vapor thus created to a second set of radiant coils of the pyrolysis furnace where the hydrocarbons are cracked to produce olefins; the cracking conditions in the second set of radiant pyrolysis coils being controlled to achieve cracking severity appropriate for the quality of this second feed fraction, wherein
d. the particular set of radiant pyrolysis coils associated with the particular feed fraction are matched to achieve specific target cracking severity in order to enhance the overall production of $C_2$ and $C_3$ mono-olefins or optimize yields for overall improved profitability.

In a preferred embodiment where the feedstock contains non-vaporizable components or a large amount of high boiling point foulants and/or coke precursors, the liquid leaving the vapor/liquid separator is only partially vaporized and it is directed into a $2^{nd}$ vapor/liquid separator where the undesirable feedstock components are removed as a liquid and the vapor from the $2^{nd}$ separator is fed to the $2^{nd}$ set of pyrolysis coils. Accordingly, in this preferred embodiment, the present invention relates to a process for pyrolyzing a wide boiling range hydrocarbon feedstock or mixtures of hydrocarbon feedstocks having a wide boiling range, consisting of a variety of hydrocarbons of differing carbon/hydrogen ratios and/or molecular weights and including undesirable high boiling point or non-vaporizable components in a pyrolysis furnace having a convection section and at least two sets of radiant pyrolysis coils, in order to produce olefins and other pyrolysis products, comprising:

a. heating and partially vaporizing the feedstock, and feeding the partially vaporized feedstock to a vapor/liquid separator device to produce separate vapor and liquid phases;
b. feeding the vapor phase to a first set of radiant pyrolysis coils of the pyrolysis furnace where the hydrocarbons are cracked to produce olefins; the cracking conditions in this first set of radiant pyrolysis coils being controlled to achieve cracking severity appropriate for the quality of this feed fraction;
c. heating the liquid phase from the first vapor/liquid separator to a temperature sufficient to vaporize a portion of the hydrocarbons, feeding the heated two phase mixture to a second vapor/liquid separator and separating the vapor phase from the liquid phase;
d. feeding the vapor phase from the second vapor/liquid separator to a second set of radiant pyrolysis coils of the pyrolysis furnace where the hydrocarbons are cracked to produce olefins; the cracking conditions in this second set of radiant pyrolysis coils being controlled to achieve cracking severity appropriate for the quality of this feed fraction; and
e. removing the liquid phase which contains undesirable and/or non-vaporizable components from the second vapor/liquid separator and disposing of it as a liquid product, typically as fuel oil, feedstock to a gasifier or feedstock to a coker.

In yet another preferred embodiment, where a high temperature vapor/liquid separator operating in the range of ~770 to 950° F. (~410 to 510° C.) is incorporated to remove undesirable high boiling feedstock components, the residence time of the liquid in the high temperature vapor/liquid separator is controlled to thermally crack the liquid and produce additional feedstock components for the radiant coils that have boiling points less than ~1000° F. (~538° C.) at atmospheric pressure. To enhance the vaporization of these desirable feedstock components, the dilution steam required to meet the dilution steam ratio target for the set of radiant coils supplied with vapor from this high temperature separator is added to the two phase hydrocarbon mixture entering the separator to provide lifting gas, i.e. gas for reducing the partial pressure of the hydrocarbons in the vapor phase of the separator and thereby cause more vaporization of the liquid to occur.

In another preferred embodiment, the process is controlled such that about the same hydrogen-to-carbon atomic ratio in the C5+ pyrolysis products is produced by each set of radiant coils. Generally, hydrogen-to-carbon atomic ratios slightly above 1.0 are preferred for pyrolysis severity control since ratios below that indicate the formation of compounds more hydrogen deficient than benzene which has a hydrogen to carbon ratio of 1.0, i.e. the formation of undesirable amounts of multi-cyclic compounds. In particular, the hydrogen-to-carbon atomic ratio is determined by procedures and methods described in U.S. Pat. No. 7,238,847, which disclosure is hereby incorporated by reference.

By way of example in order to illustrate the invention, using one or more vapor/liquid (V/L) separator(s) the feed mixture to an pyrolysis unit can be separated into its appropriate fractions, e.g. ethane/propane, $C_4$ to 350° F. (177° C.), 350-650° F. (177-343° C.), 650-1050° F. (343-566° C.) for pyrolysis in separate tubes in the radiant section of a furnace, with a pitch fraction, e.g. 1050° F.+ (566° C.+), if present, being removed from the feedstock and not pyrolyzed. Except for the 1050° F.+ (566° C.+) (pitch) fraction, each of these separated fractions, and/or combinations of them can be fed directly through the different sets of radiant coils (also termed "passes") within the same pyrolysis furnace. Each of these fractions will pass through its own set of radiant coils controlled to give the appropriate cracking severity for that feed fraction; e.g. the lighter fraction radiant pass would have a higher coil outlet temperature and higher residence time, whereas the 650-1000° F. fraction would have shorter residence time and lower coil outlet temperature. These sets of radiant coils would also have capacity flexibility; e.g. if the mixture has more light fraction components, more passes can be made available to crack this light fraction to the appropriate severity.

In the series of V/L separators, the last separator (that separates the pitch, 1050° F.+ (566° C.+)) can have the option of adding recycled pitch (1050° F.+ (566° C.+)) or addition of pyrolysis pitch to maintain complete wetting of the wall of the V/L separator. The V/L separator(s) can be a cyclonic device or simple flash drum with or without a demisting device for removing liquid entrained in the vapor. The choice of the type of V/L separator is determined by the coking propensity of the liquid being separated with the highest efficiency separators such as cyclones being required when the feedstock contains undesirable components such as pitch that cannot be tolerated as component in the feedstock to the pyrolysis coils. Typically only 2 or 3 V/L separators are needed.

In a preferred embodiment, a means of independently controlling the heating of each set of coils is provided such as controlling the fuel gas flow to rows of burners adjacent to each set of coils or by having each set of coils in separately heated radiant cells of the furnace as described in the twin cell concept by the above referenced article that appeared in the ePTQ magazine in the $2^{nd}$ Quarter of 2000. For many sets of coils in the twin cell concept separate control of the fuel gas to rows of burners adjacent to each set of coils may also be used.

Other advantages of the present invention include: 1) The ability for processing the whole desalted crude oil, and/or wide boiling feed mixtures in one cracking furnace, utilizing the heating in the furnace's preheating convection section to separate out the various feedstock fractions in a series of heating banks and vapor/liquid separators.

2) In a preferred embodiment, separate and optimum quench systems for the pyrolysis products from the different feedstock fractions are used to maximize run-length and recovery of heat by high pressure steam production; i.e. using traditional Transfer Line Exchangers (TLEs) for quenching pyrolysis products from the light fractions, and Direct Quench (DQ) alone or in combination with TLEs for quenching pyrolysis products from the heavier fractions.

3) The ability to mix different feedstocks in transportation and storage systems without sacrificing the benefits of pyrolyzing those feedstocks at their respective optimal severity. This simplifies feed import and storage logistics and provides many benefits: use of the same feed tank for different feeds, reduced cost of carrying feed inventory and sharing pipeline and ships that may otherwise require cleaning and flushing when switching feed types.

4) By separating and removing light vapor fraction(s) while a feedstock is being vaporized, the pressure requirement at the inlet of the furnace is reduced. Processing of the whole wide-boiling feed frequently runs into problems with the lighter fraction vaporizing too early in the convection section tubes, creating hydraulic back-pressure that limits the feed rate to the furnace, unless more pumping capacity is made available. Thus the invention overcomes this problem.

DETAILED DESCRIPTION OF THE INVENTION

The invention comprises a process for utilizing a pyrolysis furnace to both separate and pyrolyze separate fractions of a wide boiling hydrocarbon feedstock at optimal conditions for those fractions.

The feedstock may comprise a range of hydrocarbons, including undesirable coke precursors and/or high boiling pitch fractions that cannot be completely vaporized under convection section conditions. Examples of suitable feedstocks include, but are not limited to, natural gas liquids (NGLs), natural gasoline and condensates including those not co-produced in gas fields, long and short crude oil residues, heavy hydrocarbon streams from refinery processes, vacuum gas oils, heavy gas oil, and desalted crude oil. Other examples include, but are not limited to, deasphalted oil, oils derived from tar sands, oil shale and coal, and synthetic hydrocarbons such as SMDS (Shell Middle Distillate Synthesis) heavy ends, GTL (Gas to Liquid) heavy ends, Heavy Paraffins Synthesis products, Fischer Tropsch products and hydrocrackate.

Figure 1:
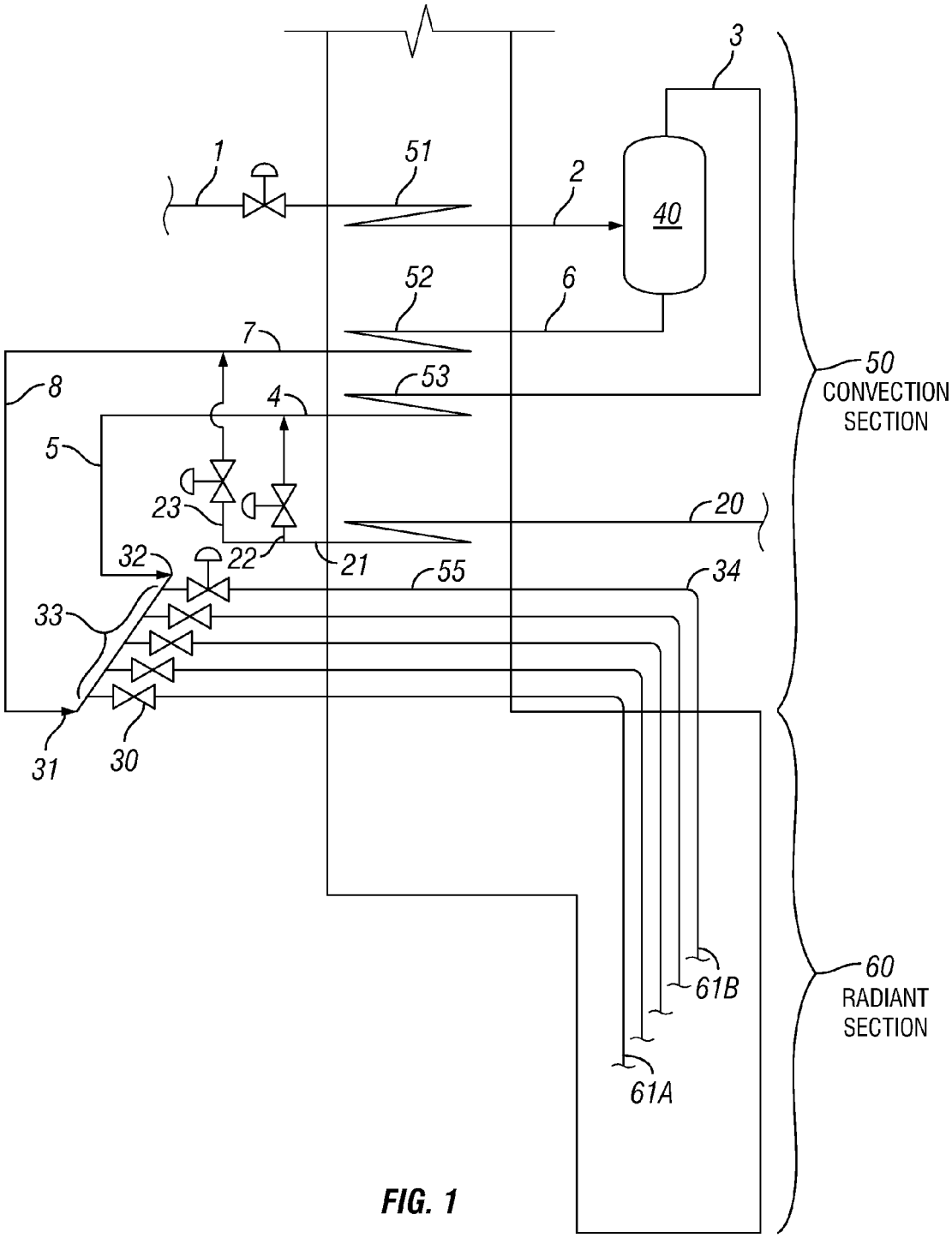
FIG. 1 is a schematic diagram representing the process flow of a preferred embodiment of the inventive process for one fully vaporizable wide boiling feedstock that utilizes one vapor/liquid separator and a single cell radiant section with two sets of coils.
Figure 2:
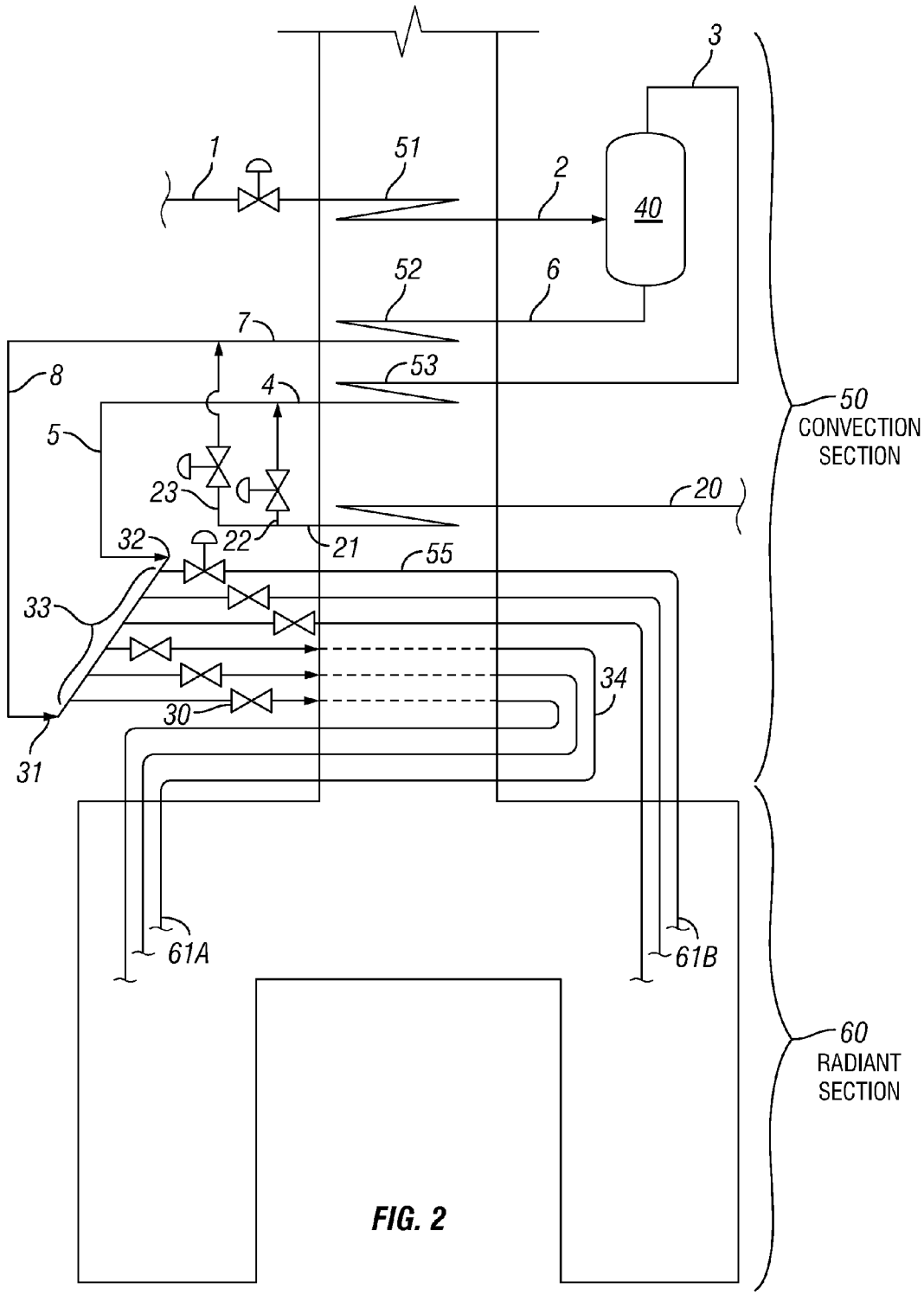
FIG. 2 is a schematic diagram representing the process flow of another preferred embodiment of the inventive process for one fully vaporizable wide boiling feedstock that utilizes one vapor/liquid separator and a twin cell radiant section, each cell having one of more sets of coils.

The pyrolysis furnace can be of any of the commonly employed designs for pyrolyzing hydrocarbon feedstocks to produce olefins, including single radiant cell designs such as illustrated in FIG. 1 and twin radiant cell designs as illustrated by FIG. 2. The only requirement for the radiant section design is that there be flowrate control for each pyrolysis coil or sets of coils or in the case that straight tubes are used instead of coils there should be flowrate control for sets of tubes in the radiant section.

Figure 3:
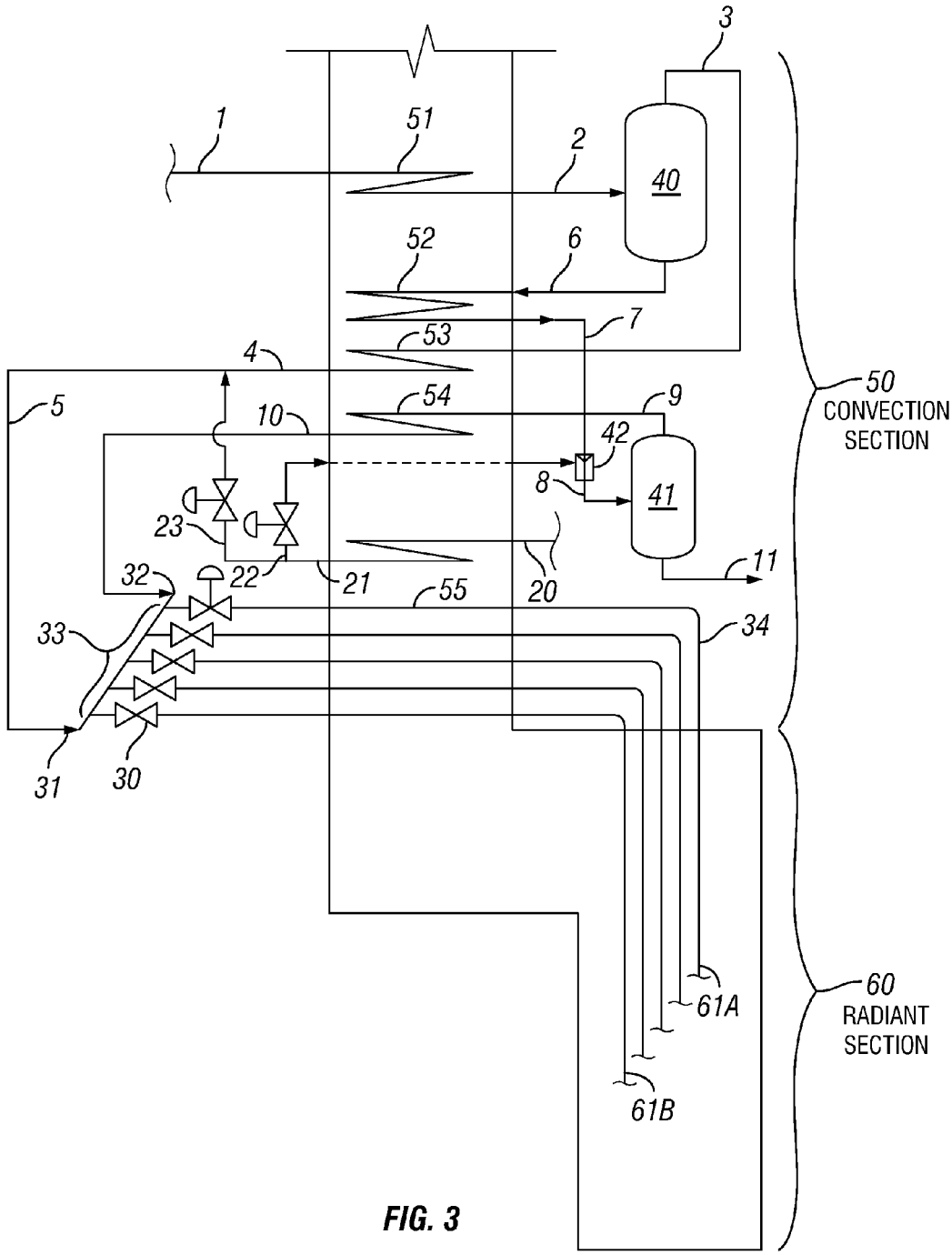
FIG. 3 is a schematic diagram representing still another preferred embodiment of the inventive process for a feedstock containing undesirable high boiling point components such as pitch that utilizes two vapor/liquid separators and a single cell radiant section with two sets of coils.

The convection section design can also be any of those commonly provided for liquid feedstock heating, vaporizing and superheating of the vaporized feedstock, however it is preferred to have a single pass design, such as shown in FIGS. 1, 2 and 3 for heating and vaporization of the feedstock as that minimizes the number of vapor/liquid separators required and typically results in high linear velocities of the feedstock while it is being heated and vaporized in the convection section tubing. High linear velocities in the range of 1-2 meters/second and more preferably 2 meters/second or higher are especially important in the tubing for imparting shear force on the wall of the tubing to help prevent the formation of deposits on the wall. Therefore, such velocities are most useful when the feedstock contains foulants or coke precursors.

Multiple feedstock pass convection section designs can also be adapted. However each feedstock pass in the convection section where the feedstock is partially vaporized will require its own vapor/liquid separator(s). For instance, it is not uncommon to have a pyrolysis furnace with 6 convection passes that feed 6 assemblies of radiant coils, such a design would require 6 vapor/liquid separators for making a feedstock split where only a light and a heavy fraction are produced.

Heating of the sets of pyrolysis coils in the radiant section of the furnace where the fractions of the feedstock are separately pyrolyzed can be done in one or more radiant cells, i.e. fireboxes contained in the furnace structure. Typically one or two cells are employed. If one cell is used it is preferred to have independent control of the heating of each set of coils such as by independent fuel gas flow control to the rows of burners nearest each set of coils. If two cells are used each cell will have independent fuel gas controls so such a design can be preferable to a single cell design since at least one of the cells and possibly both will have a single feedstock composition if a wide boiling feedstock is split into light and heavy fractions.

Flow distribution to the sets of coils in the radiant section of the furnace is especially important to ensure that all coils have sufficient flow through them to prevent rapid coke formation and short furnace run-lengths. That is accomplished by feeding all radiant coils from a common feed header as illustrated in FIGS. 1, 2 and 3 where the feedstock is split into light and heavy fractions for pyrolysis. Where only two fractions are created, each fraction enters into an opposite end of the feed header and the number of coils of the furnace that are used in the light fraction set of coils and in the heavy fraction set of coils will vary primarily according to the temperature of the vapor/liquid separator, the steam to hydrocarbon ratio in the separator, the total feedrate of the furnace and optimum flowrate per coil used for the pyrolyzing the light and heavy feedstock fractions. Where there are more than two fractions created in the convection section by use of two or more vapor/liquid separators the same basic feed header arrangement used for two fractions is used together with the additional connections provided at intermediate positions according to the amount of anticipated vapor from the intermediate fractions created so that minimum mixing of the fractions will occur in the header. For a feed header with only two feedstock fractions entering at each end there will be only one coil or coil assembly that has a mixed feedstock; for a feed header having three fractions fed to it, with proper placement of the connection of the feed line of the intermediate fraction to the header, there will be only two coils or coil assemblies that have mixed feedstock. To provide a more flexible design capable of minimizing the mixing of feedstock fractions for more than one feed composition in the header an alternate connection to the header is desirable for the intermediate fraction(s).

Examples of Flowrate Control:

The following example shows how the parallel radiant section coils or passes in a typical furnace are split up into two sets of radiant passes and how the feed rates of the light and heavy feed fractions are controlled to achieve their optimal cracking severity. To simplify the examples, the same dilution steam to feed ratio is assumed for the light and heavy fractions.

A furnace with total feedrate of 85,000 lb/hr has 20 parallel radiant passes. Feed mixture 1 contains 14.08% of the light fraction and in order for this light fraction to crack to its optimal severity, its feed rate has to be reduced such that the weight flow ratio of light to heavy feed fraction needs to be 0.948 pounds per hour of light to 1 pound per hour of heavy according to computer modeling of the pyrolysis of the light and heavy feed fractions. The above stated conditions define 4 unique relations or equations describing flow distribution in the convection section from which 4 unknowns needed for optimum flowrate control of the radiant cell coils are calculated: (1) number of coils required for pyrolyzing the light fraction, (2) number of coils required for pyrolyzing the heavy fraction, (3) feedrate per coil required for the heavy fraction and (4) feedrate per coil required for pyrolyzing the heavy fraction.

The following table shows three feed mixtures with varying amounts of light feed fractions, with different desired target feedrate ratios, and the corresponding number of radiant passes needed for the light and heavy fractions. For the two feed fractions cases shown in the following table, by feeding these two fractions from opposite ends of the feed header, and by controlling the flow rates in the light feed passes to the actual feedrate from the table, e.g. 3 passes at 3989 lb/hr for each pass for Feed Mixture 1, flows in the other passes when evenly distributed will be at their respective correct feedrates. To minimize mixing of the light and heavy fractions in the feed header, the light to heavy feedrate ratios for the passes are adjusted slightly from the "target" ratio to the "actual" ratio shown in the table so that a whole number of passes are used for the light and heavy fractions. For instance, for Feed Mixture 1, with a target light to heavy feedrate ratio of 0.948, the required number of light fraction passes was calculated to be 2.82 however to minimize mixing of the light and heavy fractions, the nearest whole number of feed passes is selected, in this case 3 passes are devoted to light fraction and the corresponding actual light to heavy feed rate ratio to the passes is thereby adjusted to 0.929.

| | Feed Mixture 1 | | | Feed Mixture 2 | | | Feed Mixture 3 | | |
|---|---|---|---|---|---|---|---|---|---|
| | Total | Lite | Hvy | Total | Lite | Hvy | Total | Lite | Hvy |
| FeedRate, lb/hr | 85,000 | 11,968 | 73,032 | 85,000 | 33,337 | 51,663 | 85,000 | 48,127 | 36,873 |
| % Light in Mixture | 14.08 | | | 39.22 | | | 56.62 | | |
| Total # of Radiant Passes | 20 | | | 20 | | | 20 | | |
| Appox # of Pass | | 2.82 | 17.18 | | 7.84 | 12.16 | | 11.32 | 8.68 |
| Target Light/Hvy FdRate Ratio | 0.948 | | | 0.781 | | | 0.888 | | |

-continued

| | Feed Mixture 1 | | | Feed Mixture 2 | | | Feed Mixture 3 | | |
|---|---|---|---|---|---|---|---|---|---|
| | Total | Lite | Hvy | Total | Lite | Hvy | Total | Lite | Hvy |
| Actual Light/Hvy FdRate Ratio | 0.929 | | | 0.789 | | | 0.870 | | |
| Actual # of Passes | | 3 | 17 | | 9 | 11 | | 12 | 8 |
| Actual FdRate/Pass | | 3,989 | 4,296 | | 3,704 | 4,697 | | 4,011 | 4,609 |

In another application a twin cell radiant section (FIG. 2) arrangement is used where a light and a heavy fraction are cracked separately in separate cells. In that case the number of radiant tubes dedicated to cracking the light and heavy fractions are fixed and the required ratio of light to heavy fractions can be achieved by mixing in the appropriate amount of the lighter feed mixture with the heavier feed mixture. In the following table, using 71,772 lb/hr of Feed Mixture 3 and 13,228 lb/hr of Feed Mixture 1, a final target feed mixture with a pre-determined desired 50% light fraction can be achieved at the same desired furnace total feed rate of 85,000 lb/hr.

| | Feed Mixture 1 | | | Feed Mixture 3 | | | TARGET Feed Mixture | | |
|---|---|---|---|---|---|---|---|---|---|
| % Light in component mixture | 14.08 | | | 56.62 | | | | | |
| Target % Light in Mixture | | | | | | | 50 | | |
| | Total | Lite | Hvy | Total | Lite | Hvy | Total | Lite | Hvy |
| FeedRate, lb/hr | 13,228 | 1,862 | 11,365 | 71,772 | 40,638 | 31,135 | 85,000 | 42,500 | 42,500 |

The invention is described below while referring to FIGS. 1 and 2 as illustrations of the invention. Referring to FIGS. 1 and 2, a fully vaporizable wide boiling range feedstock 1 enters a preheater 51 in the convection section 50 where it is partially vaporized. The preheater 51 and other preheaters in the convection section described below are typically banks of tubes wherein the contents of the tubes are heated primarily by convective heat transfer from the combustion gas exiting the radiant section 60 of the pyrolysis furnace.

The vapor/liquid mixture, 2 leaves the preheater 51 and enters a vapor/liquid separator 40 where a vapor fraction 3 and a liquid fraction 6 are produced. The vapor/liquid separator can be any separator, including a cyclone separator, a centrifuge, a flash drum or a fractionation device commonly used in heavy oil processing. The vapor/liquid separator can be configured to accept side entry feed wherein the vapor exits the top of the separator and the liquids exit the bottom of the separator, or a top entry feed wherein the product gases exit the side of the separator. In a preferred embodiment for feedstocks containing undesirable high point boiling or non-vaporizable components, the vapor/liquid separator is described in U.S. Pat. Nos. 6,376,732 and 6,632,351, which disclosures are hereby incorporated by reference.

The vapor fraction 3 leaves the vapor/liquid separator 40 and enters a preheater 53 to form a superheated vapor 4 that is comprised of the lightest portion of the feedstock. The lightest portion of the feedstock is mixed with dilution steam 22 and the resulting mixture 5 is routed into one end 32 of a vapor distribution header 33 that supplies vapor to a preheater 55 where the mixture of feedstock and dilution steam is further superheated. The superheated mixture of the lightest portion of the feedstock and dilution steam enters the crossover piping 34 and is routed into the radiant section coils or tubes 61B contained in the radiant section of the furnace 60 that pyrolyze the lightest portion of the feedstock.

In a preferred embodiment, if the feedstock contains temperature sensitive components that would foul the preheater 51, some or all of the steam 22 may be injected into the stream 2 feeding the separator 40 via a mixing nozzle, (not shown). This will lower the required outlet temperature of the preheater 51 and minimize fouling in it.

While in the embodiments described herein, the feedstock dilution gas used is steam 20, it should be understood that water may also be injected into the feedstock as taught in the '351 patent. Any source of a dilution gas may be used in place of dilution steam, the primary requirement of the dilution gas being that it does not undergo any significant pyrolytic reaction in the radiant section of the furnace. Further examples of dilution gases are methane, nitrogen, hydrogen, natural gas and gas mixtures primarily containing these components. To minimize coke formation in the radiant section coils, it is desirable to add dilution steam to the feedstock fractions pyrolyzed in the radiant section in the amount of about 0.25 to 1.0 pounds of steam per pound of hydrocarbon being fed to the radiant section, depending on the average boiling point and hydrogen to carbon ratio of the feed fraction. Accordingly, a larger dilution steam ratio will normally be required for the heavy fraction than for the light fraction leaving the separator.

The liquid fraction 6 produced by the vapor/liquid separator 40 enters a preheater 52 in the convection section 50 where it is completely vaporized. The resulting vapor is further heated as it travels through the preheater 52 and leaves the convection section 50 as a superheated vapor 7 comprised of the heaviest portion of the feedstock. The superheated vapor is mixed with dilution steam 23 and the resulting mixture 8 is routed into the end 31 of the vapor distribution header 33 opposite the end of the header 32 where the mixture of the light feedstock fraction and steam entered.

In a preferred embodiment, if the liquid leaving the vapor/liquid separator contains temperature sensitive components that will crack and deposit coke on hot heating surfaces such as components with boiling points above 650° F. (343° C.) at atmospheric pressure, then the liquid leaving the vapor/liquid separator 40 is only partially vaporized in the downstream preheater 52. To avoid formation of coke deposit on heating surfaces, the extent of vaporization in the preheater 52 is held to about 70% on a weight basis and the final vaporization is completed in a special vaporization nozzle by direct contact with superheated steam. For this purpose it is preferred to use the heavy feedstock vaporization nozzle as described in U.S. Pat. No. 4,498,629 where the final vaporization of the feedstock takes place in an annulus of steam formed within the nozzle and sufficient steam is used to superheat the feedstock vapor so the condensation of tar is prevented in unheated downstream piping.

The superheated mixture of this heaviest portion of the feedstock and dilution steam enters the crossover piping 34 and is routed into the radiant section coils or tubes 61A contained in the radiant section of the furnace 60 that pyrolyze the heaviest portion of the feedstock.

The flowrate through each of the radiant section coils is adjusted with flow control valves 30 at the inlet of the bank of heat exchanger tubes 55 where the mixtures of dilution steam and feedstock fractions are superheated before they are pyrolyzed. The composition of the feedstock routed to each of the radiant coils is determined from flow meter measurements of the total flow to the furnace 1, the flow of vapor 3 leaving the vapor/liquid separator 40 and the dilution steam 22 injected into the light fraction and the dilution steam 23 injected into the heavy fraction. With these measurements the flowrate of the light fraction and steam mixture entering the vapor distribution header at position 32 and the flowrate of the heavy fraction and steam mixture entering the vapor distribution header at position 31 are determined.

Adjustment of the individual coil flow rates entering the final preheater 55 determines the number of radiant section coils that will pyrolyze the light and heavy fractions of the feedstock and the pyrolysis residence time in those coils. These flow rates are optimized together with the operating temperature of the vapor/liquid separator, the total feedrate to the furnace and the amount of dilution steam added to the light and heavy fractions of the feedstock.

With reference to FIG. 2, the heavy feedstock fraction and light feedstock fraction are predominately pyrolyzed in coils 61A and 61B respectively which are located in separately fired radiant section cells. This arrangement permits the pyrolysis severity of the light and heavy feedstock fractions to be further optimized by providing the capability to adjust the heating of each set of coils directly by adjustment of the rate of fuel gas combustion in each cell.

In a single cell arrangement such as shown in FIGS. 1 and 3, heating of feedstock fractions in the coils and the pyrolysis residence time in the coils is controlled by adjustment of the feedrate per coil. A higher feedrate per coil is used for the heavy feedstock fraction as that results in a lower pyrolysis residence time and a lower coil outlet temperature. For the coils where the lighter feedstock fraction is pyrolyzed, a lower feedrate per coil is used as it results in a higher residence time and a higher coil outlet temperature. Optionally, the heating of sets of radiant section coils in a single cell furnace can also be adjusted by providing control for the fuel gas flow to rows of burners closest to those coils.

Referring to FIG. 3, a wide boiling range feedstock containing undesirable high boiling point components 1 enters a preheater 51 in the convection section 50 where it is partially vaporized. In a preferred embodiment, a small flow of dilution steam or water, (not shown) is injected into the preheater tubing just prior to where the initial feedstock vaporization begins for the purpose of insuring an annular flow regime is quickly obtained in the preheater.

The vapor/liquid mixture, 2 leaves the preheater 51 and enters a low temperature vapor/liquid separator 40 having a very high separation efficiency where a vapor fraction 3 and a liquid fraction 6 are produced. In one embodiment, the feedstock is heated to a temperature in the preheater 51 that promotes evaporation of the naphtha and lighter components of the feedstock.

The vapor fraction 3 leaves the vapor/liquid separator 40 and is heated in a preheater 53 to form a superheated vapor 4 that is comprised of the lightest portion of the feedstock. It is mixed with dilution steam 23 and the resulting mixture 5 is routed into one end 31 of a vapor distribution header 33 that supplies vapor to the final preheater 55 where the mixture of feedstock and dilution steam is superheated. The superheated mixture of the lightest portion of the feedstock and dilution steam enters the crossover piping 34 and is routed into the radiant section coils or tubes 61B contained in the radiant section of the furnace 60 that pyrolyze the lightest portion of the feedstock.

In a preferred embodiment, to minimize fouling of the preheater 51, some or all of the steam 23 may be injected into the stream 2 feeding the separator 40 via a mixing nozzle, (not shown). This will lower the required outlet temperature of the preheater 51 and minimize fouling in it.

The liquid fraction 6 produced by the low temperature vapor/liquid separator 40 enters a preheater 52 in the convection section 50 where it is partially vaporized. The resulting vapor/liquid mixture 7 leaves the convection section 50 and enters a nozzle 42 where dilution steam is mixed with the heavy vapor/liquid hydrocarbon mixture 7 to enhance vaporization of feedstock components with normal boiling points of less than ~1000° F. at atmospheric pressure. The resulting mixture 8 is routed into a high temperature vapor/liquid separator 41 having a very high separation efficiency where a vapor fraction 9 and a liquid fraction 11 are produced.

The vapor fraction contains nearly all of the dilution steam required for pyrolyzing it in the radiant section coils. From the vapor/liquid separator 41 the vapor fraction 9 enters a preheater 54 where it is superheated and then routed into the end 32 of the vapor distribution header 33 opposite the end of the header where the mixture of the light feedstock fraction and steam entered.

In a preferred embodiment, small flows of dilution steam, (not shown) are injected into the vapor outlets of the vapor/liquid separators to superheat them sufficiently to prevent condensation of tars on the downstream unheated piping. The superheated mixture of the heaviest portion of the feedstock and dilution steam enters the crossover piping 34 and is routed into the radiant section coils or tubes 61A contained in the radiant section of the furnace 60 that pyrolyze the heaviest portion of the feedstock.

The flowrate through each of the radiant section coils is adjusted with flow control valves 30 at the inlet of the final preheater 55 where the mixtures of dilution steam and the light and heavy feedstock fractions are superheated before they are pyrolyzed. The composition of the feedstock routed to each of the radiant coils is determined from flow meter measurements of the total flow to the furnace 1, the flow of vapor 3 leaving the low temperature vapor/liquid separator 40 and the dilution steam 22 injected into this light fraction, the flow of vapor leaving the high temperature vapor/liquid separator 9 and the dilution steam 23 injected into this heavy fraction. With these measurements the flowrate of the light fraction and steam mixture entering the vapor distribution header at position 31 and the flowrate of the heavy fraction and steam mixture entering the vapor distribution header at position 32 are determined.

Adjustment of the individual coil flow rates entering the heat exchange bank 55 determines the number of radiant section coils that will pyrolyze the light and heavy fractions of the feedstock and the pyrolysis residence time in those coils.

These flow rates are optimized together with the operating temperatures of the vapor/liquid separators, the total feedrate to the furnace and the amount of dilution steam added to the light and heavy fractions of the feedstock.

The operating temperature of the vapor/liquid separators can be controlled by many methods such as by the addition of superheated dilution steam to them or by bypassing a portion of the liquid around the preheater being used to partially vaporize the feedstock before it enters the vapor/liquid separator. Partial bypassing of the preheater can generally be done as long as the linear liquid velocity at the inlet of the preheater tubing does not fall below 1 meter/second. Below that liquid inlet velocity, the injection of steam or water to the inlet will be required to produce an annular flow regime and keep the liquid velocity at wall above 1 meter/second. For feedstocks containing large amounts of coke precursors and/or foulants, it is desirable to maintain a liquid velocity at the wall of at least 2 meters/second.

It is to be understood that the scope of the invention may include any number and types of process steps between each described process step or between a described source and destination within a process step.

The maximum cracking severity for a wide-boiling feed is determined by the maximum cracking severity of the heaviest fraction, typically defined as the average hydrogen to carbon (H/C) atomic ratio in the pyrolysis products with five carbon atoms or more, (the H/C in the C5+ portion or HCRAT), having a value of not lower than 1.00. The maximum cracking severity for whole crude (except the pitch fraction), would be when the VGO fraction is cracked to a HCRAT of 1.00. Since the naphtha fraction in the crude would be at the same coil operating temperature ("COT") as the VGO (in co-cracking of fractions in reduced whole crude), the naphtha cracking severity is limited to the HCRAT of the VGO fraction at the same COT. However, if the naphtha can be cracked separately in another furnace, or through another set of radiant coils, the naphtha can be cracked to a higher severity than that constrained by having the same COT for VGO in co-cracking.

Another aspect of the present invention is to use the method of determining the hydrogen-to-carbon atomic ratio of the C5+ fraction of the pyrolysis products in order to monitor and control the cracking severity, without encountering unacceptably high coking rate. This is taught in U.S. Pat. No. 5,840,582, and U.S. Pat. No. 7,238,847 which disclosures are incorporated herein. The '582 and '847 patents provide methods for determining the hydrogen-to-carbon atomic ratio of the C5+ pyrolysis liquid products. This allows the analytical result to be employed in a system to control the cracking severity of the pyrolysis process. Further, when the result of the analysis is corrected for the nature of the hydrocarbon feedstock and the yield of the liquid fraction, the result correlates directly to the rate of formation of coke in the pyrolysis quench process. The corrected result may thus be used to monitor and control the quench coking rate.

The following Table A lists various feeds that may be employed in the present invention, and gives recommendations for the number of vapor/liquid separators needed, the possible feed streams through the cracking furnace, and the configurations for quenching furnace effluents. In the table, DQ refers to Direct Quench and it should be understood that all feedstocks can be quenched by direct oil quench and recommendations for not using it are only for the purpose of maximizing the value of recovered heat from the pyrolysis coil effluents by the generation of high pressure steam.

TABLE A

| Feed | Process Arrangement | Feed Steams through Cracking Furnace | Configurations for Quenching Furnace Effluents |
|---|---|---|---|
| 1) Condensate | 1 V/L Separator | 1 Light + 1 Heavy | 1) Light to TLE, Hvy to DQ<br>2) Both Light & Heavy to DQ |
| 2) Mixture of Naphtha & VGO | 1 V/L Separator | 1 Light + 1 Heavy | 1) Light to TLE, Hvy to DQ<br>2) Both Light & Heavy to DQ |
| The above feeds can be fully vaporized in the furnace convection section | | | |
| 3) Crude Oil and/or Condensate containing non-vaporizable Pitch | 2 V/L Separators<br>2nd Separators generate a pitch stream not sent through cracking furnace | 1 Light + 1 Heavy | 1) Light to TLE, Hvy to DQ<br>2) Both Light & Heavy to DQ |
| 4) Long Residue (650 F+) | 1 V/L Separator<br>Separator bottom pitch stream not sent through cracking furnace | 1 Heavy | 1) Hvy to DQ |
| 5) Any Combinations of 1, 2, 3, and 4 except the (1 + 2) combination | 2 V/L Separators<br>2nd Separator generates a pitch stream not sent through cracking furnace | 1 Light + 1 Heavy | 1) Light to TLE, Hvy to DQ<br>2) Both Light & Heavy to DQ |
| 6) Feeds from 3, and 5 | 3 V/L Separators<br>3rd Separator generates a pitch stream not sent through cracking furnace | 1 Light + 1 Mid + 1 Hvy | 1) Light to TLE, Mid & Hvy to DQ<br>2) All to DQ |
| 7) Feeds from 3, and 5 | 2 V/L Separators, w/Thermal Cracking of Pitch<br>Light products from Pitch Thermal Cracking combined with Heavy feed fraction, Thermally cracked heaviest pitch not sent through cracking furnace | 1 Light + 1 Heavy w/ Thermally cracked light products | 1) Light to TLE, Hvy to DQ<br>2) Both Light & Heavy to DQ |
| 8) Feeds from 3, and 5 | 3 V/L Separators, w/Thermal Cracking of Pitch<br>Light products from Thermally cracked Pitch combined with Heavy feed fraction, Thermally cracked heaviest pitch not sent through cracking furnace | 1 Light + 1 Mid + 1 Heavy w/ Thermally cracked light products | 1) Light to TLE, Mid & Hvy to DQ<br>2) All to DQ |
| 9) Long Residue (650 F+) | 1 V/L Separator, w/Thermal Cracking of Pitch<br>Light products from Thermally cracked Pitch combined with Heavy feed fraction, Thermally cracked heaviest pitch not sent through cracking furnace | 1 Heavy w/ Thermally cracked light products | 1) Hvy to DQ |

The following examples are intended to illustrate the present invention and are not intended to unduly limit the scope of the invention.

Example 1

Processing of a Wide-Boiling Feed that can be Fully Vaporized with One V/L Separator A) Process According to the Prior Art The processing of a condensate feed in an existing furnace equipped with transfer line exchangers (TLEs), experienced very short TLE run-length at a COT of 1440° F. (782° C.) due to coking (end-of-run temperature achieved in only 7 days). In order to achieve reasonable TLE run-length, the COT had to be lowered to 1370° F. (743° C.). However, at such low cracking severity, as measured by (H/C) atomic ratio in the C5+ portion of the pyrolysis products, the pyrolysis yields were so low that cracking of this feed was made unprofitable. The short TLE run-length, at COT of 1440° F. (782° C.), was due to the heavy fraction of this wide-boiling range condensate (having a low hydrogen-content), being cracked to too high a severity, although the lighter portion of this feed was cracked to a low severity. Table 1 shows the feed properties of the light fraction (380° F.−) (193° C.−) and heavy fraction (380° F.+) (193° C.+) and the Full Range (FR) condensate, their respective individually cracking severities at COT of 1440° F. (782° C.) and 1370° F. (743° C.), and the simulated ethylene and High Value Chemicals yields.

Also shown are the yields when this feed was cracked in a furnace with a Direct Quench (DQ) instead of with a TLE for quenching the pyrolysis products. Although the yields improved (e.g. ethylene yields from 11.92% to 19.24%), while still with reasonable furnace run-length, the light fraction is still cracked at relatively low severity, as limited by the high cracking severity of the heavy fraction (at H/C ratio of C5+=1.05).

Cracking Wide-boiling Feed Whole

| | Light 380 F.− | Heavy 380 F.+ | Combined FR |
|---|---|---|---|
| Wt Frac | 0.566 | 0.434 | 1.000 |
| Feed H, % w | 14.44 | 13.42 | 14.00 |

| | Cracking Severity H/C C5+ | | | FR Feed Yields, wt % | | |
|---|---|---|---|---|---|---|
| COT | Light | Heavy | FR | C2H4 | *HVC | |
| 1370 F. | 1.81 | 1.40 | 1.63 | 11.92 | 28.19 | |
| 1440 F. | 1.54 | 1.13 | 1.35 | 17.59 | 40.24 | <--- TLE Run-length too short |
| 1465 F. | 1.42 | 1.05 | 1.26 | 19.24 | 43.37 | <--- CoCrack in DQ Furnace |

*HVC = High Value Chemicals, H2 + C2H4 + C3H6 + BD + Benzene

B. Process According to the Present Invention

This wide-boiling feed can be processed through a single V/L separator first, to produce a light and a heavy fraction, which can then be cracked separately in the radiant coils and quenched separately. After heating this feed in the convection section of the cracking furnace to ~470° F. (243° C.) at a pressure of 80 psig and flashing it in the V/L separator, the vapor from the separator becomes the light feed fraction and the liquid from the separator becomes the heavy feed fraction (as illustrated in FIG. 1). When the light feed fraction, separated from the heavy fraction of this feed in the V/L separator, is fed through the radiant coils at a lower feed rate, this light feed fraction can be cracked to a higher severity, i.e. to a lower (H/C) in C5+, resulting in higher overall pyrolysis yields. With the heavy fraction and light fractions of the feed being cracked in separate radiant coils, their pyrolysis products can also be quenched separately, by DQ and TLE respectively. The pyrolysis products from the light feed fraction only, without those from the heavy feed fraction, will have a lower coking rate in a TLE, thus allowing the light fraction to be cracked to the same or higher cracking severity in the radiant coil and still have acceptable the TLE run-length. Alternatively, both product streams can be quenched by DQ. Since the light and heavy feed fractions are cracked separately in the radiant coils, by lowering the feed rate of the light feed fraction through the radiant coils, both feed fractions can be cracked to a higher severity (e.g. at H/C in C5+ of 1.05) resulting in higher overall yields of desired products than those from co-cracking. The following table shows the cracking severity in terms of (H/C) ratio in C5+, and the overall yields with the different quench options:

Separate Cracking of Light and Heavy Feed Fractions

| | | | | FR Feed Yields, wt % | |
|---|---|---|---|---|---|
| | Light | Heavy | FR | C2H4 | *HVC |
| Quench System used | TLE | DQ | | | |
| Cracking Severity H/C C5+ | 1.15 | 1.05 | 1.11 | 21.60 | 47.01 |
| Relative feed rates in Radiant Coils | 0.94 | 1 | | | |
| Quench System used | DQ | DQ | | | |
| Cracking Severity H/C C5+ | 1.05 | 1.05 | 1.05 | 22.54 | 47.76 |
| Relative feed rates in Radiant Coils | 0.89 | 1 | | | |

This example shows that the pyrolysis yields can be greatly improved (e.g. ethylene yields improved from 11.92% to 22.54%), by using the V/L separator to allow separate cracking of the light and heavy feed fraction of this wide-boiling condensate feed, while achieving acceptable furnace run-length, and cracking at the severity appropriate to the available furnace quenching system.

Example 2

Processing of a Wide-Boiling Feed that Contains a Non-Vaporizable Fraction (Crude Oil), with Two or Three V/L Separators A. Process According to the Prior Art This example illustrates how the concept of separate cracking of the light and heavy feed fractions of a wide-boiling feed can be applied to the processing of a crude oil or feed mixture containing a non-vaporizable fraction. The following table shows feed properties of the different fractions: light, medium, heavy and pitch fractions of this crude with their respective boiling ranges:

| Feed Properties | | | | | |
|---|---|---|---|---|---|
| | IBP-350 Light | 350-650 Medium | 650-1050 Heavy | 1050+ Pitch | Total Whole Crude |
| Mol Wt Range | 30-140 | 140-290 | 290-630 | 630-1100+ | 30-1100+ |
| Wt % of Crude | 39.22 | 29.54 | 22.81 | 8.43 | 100.00 |
| % H in Feed | 14.99 | 13.68 | 12.85 | 12.02 | |

The first V/L separator, flashed at ~390° F. (~199° C.), with a dilution steam to hydrocarbon vapor weight ratio of 0.5 and a pressure of 100 psig produces the light feed fraction (IBP-350, Initial Boiling Point to 350° F. (177° C.)) and a liquid fraction (containing the heavy feed fraction and the non-vaporizable fraction). This light fraction is cracked in a set of radiant coils at reduced feed rate (relative to the feed rate of the heavy feed fraction). The liquid fraction from this first V/L separator, after further heating to 770° F. (410° C.) at 80 psig with a dilution steam to hydrocarbon vapor weight ratio of 0.55 is directed into the second V/L separator, the vapor of which becomes the heavy (i.e. the medium+heavy fractions listed in the above table) fraction of the feed, which is cracked in the radiant coil for heavy fraction cracking. Liquid from this second V/L separator contains mainly the non-vaporizable fraction of this feed which is not cracked in the radiant coil. Without the first V/L separator, the light and heavy feed fractions (without the non-vaporizable fraction) will be cracked together in the same radiant coils. The maximum cracking severity of the lowest quality feed fraction (Vacuum Gas Oil, VGO, in this case) sets the COT of the whole furnace.

In the following table, COT corresponding to the maximum cracking severity for the Heavy feed fraction (at H/C ratio in C5+ of 1.05) is at 1423° F. (773° C.). The lighter feed fractions (light and medium fractions) when co-cracked with the heavy feed fraction are heated to this same COT, resulting in a lower cracking severity as measured by (H/C in C5+ of 1.65, and 1.19 respectively for the light and medium fractions). The pyrolysis yields of these different component feed fractions and the overall pyrolysis yields are shown in the following table:

| One Separator for pitch removal | | | | | |
|---|---|---|---|---|---|
| | Wt % of Crude | | | | |
| | 39.22 Light | 29.54 Medium | 22.81 Heavy | 91.57 Overall | 8.43 Pitch |
| Boiling Range | IBP-350 F. | 350-650 F. | 650-1050 F. | Pyrolysis Yields | 1050 F.+ |
| COT, deg F. | 1423 | 1423 | 1423 | 1423 | |
| (H/C) Ratio in C5+ | 1.65 | 1.19 | 1.05 | **1.36 | |
| Wt % Ethylene Yield | 18.10 | 19.02 | 17.04 | 18.13 | |
| Wt % HVC | 41.18 | 41.80 | 38.79 | 40.78 | |

**Equivalent Cracking Severity

B. Process According to the Present Invention

With an additional V/L separator, that separates the Light feed fraction so that it can be cracked in its own set of radiant coils, it can be cracked to a higher cracking severity. The maximum cracking severity for this light fraction depends on the type of quench system used in the furnace; the maximum cracking severity in terms of (H/C) ratio in C5+ is at 1.15 and 1.05 respectively for a TLE and a DQ quench system and still have reasonable furnace run-length. The medium and heavy feed fractions are co-cracked, to the maximum severity as determined by the heavy feed fraction. The yields and severity for these two different cases are shown in the following two tables:

| Two Separators: Lite & Heavy, Use TLE for Light | | | | | |
|---|---|---|---|---|---|
| | Light | Medium | Heavy | Overall | Pitch |
| Boiling Range | IBP-350 F. | 350-650 F. | 650-1050 F. | Pyrolysis Yields | 1050 F.+ |
| COT, deg F. | 1520 | 1423 | 1423 | | |
| (H/C) Ratio in C5+ | 1.15 | 1.19 | 1.05 | **1.14 | |
| Wt % Ethylene Yield | 25.92 | 19.02 | 17.04 | 21.48 | |
| Wt % HVC | 53.54 | 41.80 | 38.79 | 46.08 | |

**Equivalent Cracking Severity

| Two Separators: Lite & Heavy, Use DQ for All | | | | | |
|---|---|---|---|---|---|
| | Light | Medium | Heavy | Overall | Pitch |
| Boiling Range | IBP-350 F. | 350-650 F. | 650-1050 F. | Pyrolysis Yields | 1050 F.+ |
| COT, deg F. | 1549 | 1423 | 1423 | | |

-continued

| Two Separators: Lite & Heavy, Use DQ for All | | | | | |
|---|---|---|---|---|---|
| | Light | Medium | Heavy | Overall | Pitch |
| (H/C) Ratio in C5+ | 1.05 | 1.19 | 1.05 | **1.10 | |
| Wt % Ethylene Yield | 27.47 | 19.02 | 17.04 | 22.14 | |
| Wt % HVC | 54.62 | 41.80 | 38.79 | 46.54 | |

**Equivalent Cracking Severity

With a 3 V/L separator case, we can further separate the medium fraction from the heavy fraction and have its feed rate adjusted to reach its own maximum cracking severity as shown in the following table:

| Three Separators: Lite, Med, Heavy, DQ for All | | | | | |
|---|---|---|---|---|---|
| | Light | Medium | Heavy | Overall | Pitch |
| Boiling Range | IBP-350 F. | 350-650 F. | 650-1050 F. | Pyrolysis Yields | 1050 F.+ |
| COT, deg F. | 1549 | 1469 | 1423 | | |
| (H/C) Ratio in C5+ | 1.05 | 1.05 | 1.05 | **1.05 | |
| Wt % Ethylene Yield | 27.47 | 21.05 | 17.04 | 22.80 | |
| Wt % HVC | 54.62 | 45.44 | 38.79 | 47.72 | |

**Equivalent Cracking Severity

This example shows that after separating out the pitch fraction of the crude, by further separating out the light, medium and heavy fraction of the pyrolysis feeds with additional V/L separators, and by adjusting the feed rates of these feeds through their respective sets of radiant coils, the severity for each of these feed fractions can be cracked to its own maximum or optimal cracking severity, and not be limited by the maximum severity of the lowest quality feed fraction. In this case, the overall ethylene yield can be increased from 18.1% to 22.8% with separate cracking to the maximum severity.

That which is claimed is:

1. A process for pyrolyzing a wide boiling range vaporizable hydrocarbon feedstock or mixtures of hydrocarbon feedstocks having a wide boiling range, comprising a variety of hydrocarbons of differing carbon/hydrogen ratios and/or molecular weights in a pyrolysis furnace having a convection section, least two sets of radiant pyrolysis coils, and a vapor distribution header to produce olefins and other pyrolysis products, comprising:

a. heating and partially vaporizing a feedstock, and feeding the partially vaporized feedstock to a vapor/liquid separator device to produce fractions comprising separate vapor and liquid phases;

b. feeding the vapor phase fraction to the vapor distribution header and then to a first set of radiant pyrolysis coils of a pyrolysis furnace operated at a first set of cracking conditions where the hydrocarbons are cracked to produce olefins; and c. heating and fully vaporizing the liquid phase fraction from the vapor/liquid separator, and feeding the vapor phase thus created to the vapor distribution header and then to a second set of radiant coils of the pyrolysis furnace operated at a second set of cracking conditions where the hydrocarbons are cracked to produce olefins.

2. The process of claim 1 wherein said cracking conditions in the particular set of radiant pyrolysis coils includes feed rate, residence time, temperature history, heat input and dilution steam to feed ratio.

3. The process of claim 1 wherein the hydrocarbon feedstock is selected from the group of fully vaporizable feedstocks consisting of (i) natural gas liquids (NGLs), (ii) condensate, (iii) mixtures of gas oil, naphtha and/or gasoline, (iv) synthetic hydrocarbons, and (v) mixtures of vacuum gas oil with naphtha added to prevent solidification of paraffin wax contained in the feedstock in un-heated storage and transportation facilities.

4. The process of claim 3 wherein the hydrocarbon feedstock is a condensate comprising a wide-boiling point range feed, with a density from 0.71 to 0.80 g/cm3, a hydrogen content from 13.0% to 15%, an initial boiling point from ambient temperature to a final boiling point of about 1000° F. (538° C.

5. The process of claim 3 wherein the hydrocarbon feedstock comprises mixtures of vacuum gas oil with naphtha added to prevent solidification of paraffin wax contained in the feedstock in un-heated storage and transportation facilities.

6. The process of claim 1 wherein a mixture of hydrocarbon feedstocks are used.

7. The process of claim 1 wherein a diluent gas or liquid or mixtures thereof are added to the hydrocarbon feedstock prior to entering the radiant pyrolysis coils.

8. The process of claim 7 wherein said diluent gas is selected from the group consisting of steam, methane, ethane, nitrogen, hydrogen, natural gas and refinery off-gas and said diluent liquid is water.

9. The process of claim 1 wherein the vapor/liquid separator is selected from the group consisting of a flash vessel, a vertical drum, a horizontal drum, a fractionation column, a centrifugal separator and a cyclone.

10. The process of claim 9 wherein the vapor/liquid separator is a flash vessel.

11. The process of claim 1 wherein the hydrogen-to-carbon atomic ratio of the C5+ portion of the pyrolysis products from each set of radiant coils is used to control the cracking severity in those coils.

12. The process of claim 11 wherein the hydrogen-to-carbon atomic ratio is determined by analyzing the ultraviolet absorbance of the C5+ portion of the pyrolysis products and by correlating the values of the resulting absorbance to the hydrogen-to-carbon atomic ratio of C5+ portion of the pyrolysis products from each set of radiant pyrolysis coils.

13. The process of claim 1 wherein said feedstock is a fully vaporizable wide boiling range feedstock, and wherein two vapor/liquid separators are used in combination with the convection section of the furnace to form three separate vapor feedstocks for three sets of radiant pyrolysis coils.

14. The process of claim 1 wherein said feedstock is a fully vaporizable wide boiling range feedstock, and wherein three vapor/liquid separators are used in combination with the convection section of the furnace to form four separate vapor feedstocks for four sets of radiant pyrolysis coils.

15. The process of claim 1 wherein said pyrolysis furnace has a single radiant cell.

16. The process of claim 1 wherein said pyrolysis furnace has two radiant cells.

17. A process for pyrolyzing a wide boiling range hydrocarbon feedstock or mixtures of hydrocarbon feedstocks having a wide boiling range, comprising a variety of hydrocarbons of differing carbon/hydrogen ratios and/or molecular weights and including undesirable high boiling point and/or non-vaporizable components in an pyrolysis furnace having a convection section, least two sets of radiant pyrolysis coils, and a vapor distribution header in order to produce olefins and other pyrolysis products, comprising:

a. heating and partially vaporizing a feedstock, and feeding the partially vaporized feedstock to a vapor/liquid separator device to produce fractions comprising separate vapor and liquid phases;

b. feeding the vapor phase to the vapor distribution header and then to a first set of radiant pyrolysis coils of a pyrolysis furnace operated at a first set of cracking conditions where the hydrocarbons are cracked to produce olefins;

c. heating the liquid phase from the first vapor/liquid separator to a temperature sufficient to vaporize a portion of the hydrocarbons, feeding the heated two phase mixture to a second vapor/liquid separator and separating the vapor phase fraction from the liquid phase fraction;

d. feeding the vapor phase from the second vapor/liquid separator to the vapor distribution header and then to a second set of radiant pyrolysis coils of the olefins pyrolysis furnace operated at a second set of cracking conditions where the hydrocarbons are cracked to produce olefins;

e. removing the liquid phase fraction which contains undesirable and/or non-vaporizable components from the second vapor/liquid separator.

18. The process of claim 17 wherein said cracking conditions in the particular set of radiant pyrolysis coils includes feed rate, residence time, temperature history, heat input and dilution steam to feed ratio.

19. The process of claim 18 wherein the liquid phase from step e is removed and used as fuel oil, feedstock to a gasifier or feedstock to a coker.

20. The process of claim 18 wherein the liquid phase from step e is subjected to thermal cracking to produce additional hydrocarbon components having boiling points below 1000° F. (538° C.), which are subsequently vaporized and included in the feed to the second set of radiant pyrolysis coils, and the remaining liquid portion from the thermal cracking is removed and used as fuel oil, feedstock to a gasifier or feedstock to a coker.

21. The process of claim 17 wherein three vapor/liquid separators are used in combination with the convection section of the furnace to form three separate vapor feedstocks for three sets of radiant pyrolysis coils.

22. The process of claim 17 wherein the vapor/liquid separator is selected from the group consisting of a flash vessel, a vertical drum, a horizontal drum, a fractionation column, a centrifugal separator and a cyclone.

23. The process of claim 17 wherein the hydrogen-to-carbon atomic ratio of the C5+ portion of the pyrolysis products from each set of radiant coils is used to control the cracking severity in those coils.

24. The process of claim 23 wherein the hydrogen-to-carbon atomic ratio is determined by analyzing the ultraviolet absorbance of the C5+ portion of the pyrolysis products and by correlating the values of the resulting absorbance to the hydrogen-to-carbon atomic ratio of C5+ portion of the pyrolysis products from each set of radiant pyrolysis coils.

25. The process of claim 17 wherein said feedstock is selected from the group consisting of (i) short residue, (ii) long residue, (iii) desalted crude oil, (iv) oils derived from coal, shale oil and tar sands, (v) heavy component products from synthetic hydrocarbon processes selected from SMDS, gas to liquids, heavy paraffin synthesis and Fischer-Tropsch and (vi) heavy ends from hydrocrackate.

26. The process of claim 17 wherein said feedstock is short residue or vacuum tower bottom.

27. The process of claim 17 wherein said pyrolysis furnace has a single radiant cell.

28. The process of claim 17 wherein said pyrolysis furnace has two radiant cells.

* * * * *